US006162982A

United States Patent [19]

Aoki

[11] Patent Number: 6,162,982

[45] Date of Patent: Dec. 19, 2000

[54] AUTOMATIC COMPOSITION APPARATUS AND METHOD, AND STORAGE MEDIUM THEREFOR

[75] Inventor: Eiichiro Aoki, Hamamatsu, Japan

[73] Assignee: Yamaha Corporation, Japan

[21] Appl. No.: 09/491,432

[22] Filed: Jan. 26, 2000

[30] Foreign Application Priority Data

Jan. 29, 1999 [JP] Japan ..... 11-023051

[51] Int. Cl.[7] ..... G10H 1/40; G10H 7/00

[52] U.S. Cl. ..... 84/611; 84/609; 84/610; 84/634; 84/635; 84/649; 84/650; 84/651

[58] Field of Search ..... 84/600–606, 609–614, 84/622–625, 634–638, 649–652, 659–660, 666–669

[56] References Cited

U.S. PATENT DOCUMENTS

| | | | |
|---|---|---|---|
| 5,736,663 | 4/1998 | Aoki et al. | 84/609 |
| 5,801,694 | 9/1998 | Gershen | 84/602 |
| 6,075,193 | 6/2000 | Aoki et al. | 84/609 |

*Primary Examiner*—Robert E. Nappi
*Assistant Examiner*—Marlon Fletcher
*Attorney, Agent, or Firm*—Rossi & Associates

[57] ABSTRACT

There are provided an automatic composition apparatus and a method for automatically composing a piece of music, which enable a user to generate a large number of melodies having different atmospheres using a reduced number of melody generating templates, and a storage medium storing a program for executing the method. A plurality of piece-of-music-independent templates containing various information independent of pieces of music are supplied to generate melodies of the pieces of music. A plurality of piece-of-music-dependent templates containing various information dependent on the pieces of music are supplied to generate melodies of the pieces of music. A piece-of-music-independent template is selected from the supplied plurality of piece-of-music-independent templates. A piece-of-music-dependent template is selected from the supplied plurality of piece-of-music-dependent templates. A melody of a piece of music is generated based on information contained in the selected piece-of-music-independent template and piece-of-music-dependent template.

32 Claims, 7 Drawing Sheets

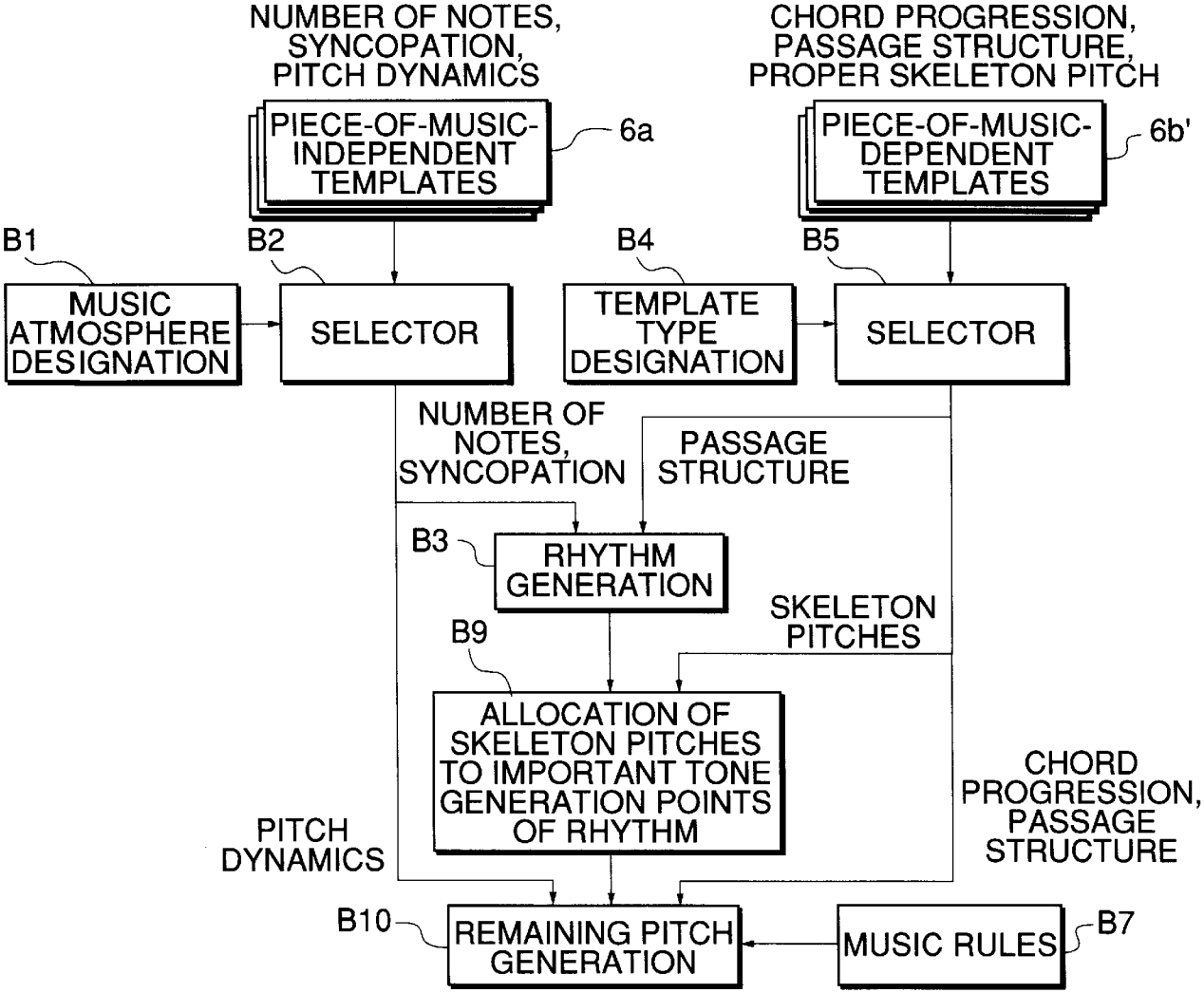
FIG.4
NUMBER OF NOTES, SYNCOPATION, PITCH DYNAMICS
PIECE-OF-MUSIC-INDEPENDENT TEMPLATES
6a
B2
CHORD PROGRESSION, PASSAGE STRUCTURE, PROPER SKELETON PITCH
PIECE-OF-MUSIC-DEPENDENT TEMPLATES
6b'
B5
B1
MUSIC ATMOSPHERE DESIGNATION
SELECTOR
B4
TEMPLATE TYPE DESIGNATION
SELECTOR
NUMBER OF NOTES, SYNCOPATION
PASSAGE STRUCTURE
B3
RHYTHM GENERATION
SKELETON PITCHES
B9
ALLOCATION OF SKELETON PITCHES TO IMPORTANT TONE GENERATION POINTS OF RHYTHM
CHORD PROGRESSION, PASSAGE STRUCTURE
PITCH DYNAMICS
B7
MUSIC RULES
B10
REMAINING PITCH GENERATION

AUTOMATIC COMPOSITION APPARATUS AND METHOD, AND STORAGE MEDIUM THEREFOR

BACKGROUND OF THE INVENTION

1. Field of the Invention

The present invention relates to an automatic composition apparatus and method for automatically composing a melody based on melody generating templates, and a storage medium storing a program for executing the method.

2. Prior Art

An automatic composition apparatus has been conventionally known, which stores a plurality of melody generating templates that contain data needed for generating melodies such as passage structures, chord progressions, rhythm characteristics, and pitch characteristics, and automatically composes a melody of a piece of music based on a selected melody generating template.

In the prior art automatic composition apparatus, however, to increase the number or kind of melodies that can be generated, it is necessary to prepare a correspondingly increased number of melody generating templates. This is because an attempt to generate different melodies using the same melody generating template unavoidably results in melodies of a similar atmosphere having the same passage structure, chord progression, rhythm characteristic and pitch characteristic.

Thus, there is a need to prepare a large number of melody generating templates, which requires an enormous amount of labor and time as well as a huge capacity of memory to store the large number of melody generating templates.

SUMMARY OF THE INVENTION

It is an object of the present invention to provide an automatic composition apparatus and method for automatically composing a piece of music, which enables a user to generate a large number of melodies having different atmospheres using a reduced number of melody generating templates and a storage medium storing a program for executing the method.

To attain the above object, according to a first aspect of the present invention, there is provided an automatic composition apparatus comprising a piece-of-music-independent template supplying device that supplies a plurality of piece-of-music-independent templates containing various information independent of pieces of music, to generate melodies of the pieces of music, a piece-of-music-dependent template supplying device that supplies a plurality of piece-of-music-dependent templates containing various information dependent on the pieces of music, to generate melodies of the pieces of music, a piece-of-music-independent template selecting device that selects a piece-of-music-independent template from the supplied plurality of piece-of-music-independent templates, a piece-of-music-dependent template selecting device that selects a piece-of-music-dependent template from the supplied plurality of piece-of-music-dependent templates, and a melody generating device that generates a melody of a piece of music based on information contained in the selected piece-of-music-independent template and piece-of-music-dependent template.

To attain the above object, according to a second aspect of the present invention, there is provided an automatic composition apparatus comprising a piece-of-music-independent template supplying device that supplies a plurality of piece-of-music-independent templates containing various information independent of pieces of music, including rhythm characteristics and pitch characteristics of the pieces of music, to generate melodies of the pieces of music, a piece-of-music-dependent template supplying device that supplies a plurality of piece-of-music-dependent templates containing various information dependent on the pieces of music, including structures and chord progressions of the pieces of music, to generate melodies of the pieces of music, a piece-of-music-independent template selecting device that selects a piece-of-music-independent template from the supplied plurality of piece-of-music-independent templates, a piece-of-music-dependent template selecting device that selects a piece-of-music-dependent template from the supplied plurality of piece-of-music-dependent templates, a rhythm generating device that generates a rhythm of a piece of music based on the rhythm characteristic of a piece of music contained in the selected piece-of-music-independent template and the structure of a piece of music contained in the selected piece-of-music-dependent template, and a melody generating device that generates a melody of a piece of music by generating a pitch for each tone-generation point of the generated rhythm, based on the pitch characteristic of a piece of music contained in the selected piece-of-music-independent template and the structure and chord progression of a piece of music contained in the selected piece-of-music-dependent template.

Preferably, the rhythm characteristic includes a number of notes constituting the melody of the piece of music to be generated and presence or absence of syncopation in the piece of music to be generated, and wherein the pitch characteristic includes pitch dynamics of the notes constituting the melody of the piece of music to be generated.

To attain the above object, according to a third aspect of the present invention, there is provided an automatic composition apparatus comprising a piece-of-music-independent template supplying device that supplies a plurality of piece-of-music-independent templates containing various information independent of pieces of music, including rhythm characteristics and pitch characteristics of the pieces of music, to generate melodies of the pieces of music, a piece-of-music-dependent template supplying device that supplies a plurality of piece-of-music-dependent templates containing various information dependent on the pieces of music, including structures and chord progressions of the pieces of music, to generate melodies of the pieces of music, a piece-of-music-independent template selecting device that selects a piece-of-music-independent template from the supplied plurality of piece-of-music-independent templates, a piece-of-music-dependent template selecting device that selects a piece-of-music-dependent template from the supplied plurality of piece-of-music-dependent templates, a rhythm generating device that generates a rhythm of a piece of music based on the rhythm characteristic of a piece of music contained in the selected piece-of-music-independent template and the structure of a piece of music contained in the selected piece-of-music-dependent template, a skeleton pitch generating device that generates skeleton pitches of a piece of music by operation based on the structure and chord progression of a piece of music contained in the selected piece-of-music-dependent template, an allocating device that allocates the generated skeleton pitches to important tone-generation points of the generated rhythm, and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

To attain the above object, according to a fourth aspect of the present invention, there is provided an automatic composition apparatus comprising a piece-of-music-independent template supplying device that supplies a plurality of piece-of-music-independent templates containing various information independent of pieces of music, including rhythm characteristics and pitch characteristics of the pieces of music, to generate melodies of the pieces of music, a piece-of-music-dependent template supplying device that supplies a plurality of piece-of-music-dependent templates containing various information dependent on the pieces of music, including structures, chord progressions and skeleton pitches of the pieces of music, to generate melodies of the pieces of music, a piece-of-music-independent template selecting device that selects a piece-of-music-independent template from the supplied plurality of piece-of-music-independent templates, a piece-of-music-dependent template selecting device that selects a piece-of-music-dependent template from the supplied plurality of piece-of-music-dependent templates, a rhythm generating device that generates a rhythm of a piece of music based on the rhythm characteristic of a piece of music contained in the selected piece-of-music-independent template and the structure of a piece of music contained in the selected piece-of-music-dependent template, an allocating device that allocates the skeleton pitches contained in the selected piece-of-music-dependent template to important tone-generation points of the generated rhythm, and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

To attain the above object, according to a fifth aspect of the present invention, there is provided an automatic composition apparatus comprising a piece-of-music-independent template supplying device that supplies a plurality of piece-of-music-independent templates containing various information independent of pieces of music, including rhythm characteristics and pitch characteristics of the pieces of music, to generate melodies of the pieces of music, a piece-of-music-dependent template supplying device that supplies a plurality of piece-of-music-dependent templates containing various information dependent on the pieces of music, including structures and chord progressions of the pieces of music, and skeleton pitches of at least one higher layer among skeleton pitches of a plurality of layers that constitute a piece of music, to generate melodies of the pieces of music, a piece-of-music-independent template selecting device that selects a piece-of-music-independent template from the supplied plurality of piece-of-music-independent templates, a piece-of-music-dependent template selecting device that selects a piece-of-music-dependent template from the supplied plurality of piece-of-music-dependent templates, a rhythm generating device that generates a rhythm of a piece of music based on the rhythm characteristic of a piece of music contained in the selected piece-of-music-independent template and the structure of a piece of music contained in the selected piece-of-music-dependent template, a skeleton pitch generating device that generates skeleton pitches of at least one lower layer of a piece of music by operation based on the structure and chord progression of a piece of music, and the skeleton pitches of at least one higher layer of a piece of music contained in the selected piece-of-music-dependent template, an allocating device that allocates the skeleton pitches of at least one higher layer of a piece of music contained in the selected piece-of-music-dependent template and the generated skeleton pitches of at least one lower layer of a piece of music, to important tone-generation points of the generated rhythm, and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

Preferably, the skeleton pitches of a piece of music comprise a plurality of layers formed of overall skeleton pitches, passage skeleton pitches and phrase skeleton pitches of the piece of music, the overall skeleton pitches forming a highest layer, the passage skeleton pitches and the phrase skeleton pitches forming lower layers in an order mentioned.

To attain the above object, according to a sixth aspect of the present invention, there is provided an automatic composition apparatus comprising a piece-independent template supplying device that supplies a plurality of piece-of-music-independent templates containing various information independent of pieces of music, including rhythm characteristics and pitch characteristics of the pieces of music, and common skeleton pitches independent of the pieces of music, to generate melodies of the pieces of music, a piece-of-music-dependent template supplying device that supplies a plurality of piece-of-music-dependent templates containing various information dependent on the pieces of music, including structures and chord progressions of the pieces of music, to generate melodies of the pieces of music, a piece-of-music-independent template selecting device that selects a piece-of-music-independent template from the supplied plurality of piece-of-music-independent templates, a piece-of-music-dependent template selecting device that selects a piece-of-music-dependent template from the supplied plurality of piece-of-music-dependent templates, a rhythm generating device that generates a rhythm of a piece of music based on the rhythm characteristic of a piece of music contained in the selected piece-of-music-independent template and the structure of a piece of music contained in the selected piece-of-music-dependent template, a skeleton pitch generating device that generates skeleton pitches matching a piece of music to be generated by operation based on the common skeleton pitches contained in the selected piece-of-music-independent template and the structure and the chord progression of a piece of music contained in the selected piece-of-music-dependent template, an allocating device that allocates the generated skeleton pitches to important tone-generation points of the generated rhythm, and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

In a preferred form of the first to sixth aspects of the present invention, the automatic composition apparatus further comprises a music rule supplying device that supplies music rules, and the melody generating device generates the melody of the piece of music based on the supplied music rules.

In a further preferred form of the first to sixth aspects of the present invention, the automatic composition apparatus further comprises a music atmosphere designating device that designates a music atmosphere from a plurality of music atmospheres, and the piece-of-music-independent template supplying device supplies the plurality of piece-of-music-independent templates in correspondence to respective ones of the plurality of music atmospheres, and the piece-of-music-independent template selecting device selects a piece-of-music-independent template corresponding to the designated music atmosphere.

To attain the above object, according to a seventh aspect of the present invention, there is provided a method of automatically composing a piece of music, comprising the steps of supplying a plurality of piece-of-music-independent templates containing various information independent of pieces of music, to generate a melody of a piece of music, supplying a plurality of piece-of-music-dependent templates containing various information dependent on the pieces of music, to generate melodies of the pieces of music, selecting a piece-of-music-independent template from the supplied plurality of piece-of-music-independent templates, selecting a piece-of-music-dependent template from the supplied plurality of piece-of-music-dependent templates, and generating a melody of a piece of music based on the information contained in the selected piece-of-music-independent template and piece-of-music-dependent template.

To attain the above object, according to an eighth aspect of the present invention, there is provided a method of automatically composing a piece of music, comprising the steps of supplying a plurality of piece-of-music-independent templates containing various information independent of pieces of music, including rhythm characteristics and pitch characteristics of the pieces of music, to generate melodies of the pieces of music, supplying a plurality of piece-of-music-dependent templates containing various information dependent on the pieces of music, including structures and chord progressions of the pieces of music, to generate melodies of the pieces of music, selecting a piece-of-music-independent template from the supplied plurality of piece-of-music-independent templates, selecting a piece-of-music-dependent template from the supplied plurality of piece-of-music-dependent templates, generating a rhythm of a piece of music, based on the rhythm characteristic of a piece of music contained in the selected piece-of-music-independent template and the structure of a piece of music contained in the selected piece-of-music-dependent template, and generating a melody of a piece of music by generating a pitch for each tone-generation point of the generated rhythm, based on the pitch characteristic of a piece of music contained in the selected piece-of-music-independent template and the structure and the chord progression of a piece of music contained in the selected piece-of-music-dependent template.

To attain the above object, according to a ninth aspect of the present invention, there is provided a method of automatically composing a piece of music, comprising steps of supplying a plurality of piece-of-music-independent templates containing various information independent of pieces of music, including rhythm characteristics and pitch characteristics of the pieces of music, to generate melodies of the pieces of music, supplying a plurality of piece-of-music-dependent templates containing various information dependent on the pieces of music, including structures and chord progressions of the pieces of music, to generate melodies of the pieces of music, selecting a piece-of-music-independent template from the supplied plurality of piece-of-music-independent templates, selecting a piece-of-music-dependent template from the supplied plurality of piece-of-music-dependent templates, generating a rhythm of a piece of music, based on the rhythm characteristic of a piece of music contained in the selected piece-of-music-independent template and the structure of a piece of music contained in the selected piece-of-music-dependent template, generating skeleton pitches of a piece of music by operation based on the structure and the chord progression of a piece of music contained in the selected piece-of-music-dependent template, allocating the generated skeleton pitches to important tone-generation points of the generated rhythm, and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

To attain the above object, according to a tenth aspect of the present invention, there is provided a method of automatically composing a piece of music, comprising steps of supplying a plurality of piece-of-music-independent templates containing various information independent of pieces of music, including rhythm characteristics and pitch characteristics of the pieces of music, to generate melodies of the pieces of music, supplying a plurality of piece-of-music-dependent templates containing various information dependent on the pieces of music, including structures, chord progressions and skeleton pitches of the pieces of music, to generate melodies of the pieces of music, selecting a piece-of-music-independent template from the supplied plurality of piece-of-music-independent templates, selecting a piece-of-music-dependent template from the supplied plurality of piece-of-music-dependent templates, generating a rhythm of a piece of music, based on the rhythm characteristic of a piece of music contained in the selected piece-of-music-independent template and the structure of a piece of music contained in the selected piece-of-music-dependent template, allocating skeleton pitches of a piece of music contained in the selected piece-of-music-dependent template, to important tone-generation points of the generated rhythm, and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

To attain the above object, according to an eleventh aspect of the present invention, there is provided a method of automatically composing a piece of music, comprising the steps of supplying a plurality of piece-of-music-independent templates containing various information independent of pieces of music, including rhythm characteristics and pitch characteristics of the pieces of music, to generate melodies of the pieces of music, supplying a plurality of piece-of-music-dependent templates containing various information dependent on the pieces of music, including structures and chord progressions of the pieces of music, and skeleton pitches of at least one higher layer among skeleton pitches of a plurality of layers that constitute a piece of music, to generate melodies of the pieces of music, selecting a piece-of-music-independent template from the supplied plurality of piece-of-music-independent templates, selecting a piece-of-music-dependent template from the supplied plurality of piece-of-music-dependent templates, generating a rhythm of a piece of music, based on the rhythm characteristic of a piece of music contained in the selected piece-of-music-independent template and the structure of a piece of music contained in the selected piece-of-music-dependent template, generating skeleton pitches of at least one lower layer of a piece of music by operation based on the structure and the chord progression of a piece of music and the skeleton pitches of at least one higher layer of a piece of music contained in the selected piece-of-music-dependent template, allocating the skeleton pitches of at least one higher layer of a piece of music contained in the selected piece-of-music-dependent template and the generated skeleton pitches of at least one lower layer of a piece of music, to important tone-generation points of the generated rhythm, and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

To attain the above object, according to a twelfth aspect of the present invention, there is provided a method of automatically composing a piece of music, comprising the steps of supplying a plurality of piece-of-music-independent templates containing various information independent of pieces of music, including rhythm characteristics and pitch characteristics of the pieces of music and common skeleton pitches independent of the pieces of music, to generate melodies of the pieces of music, supplying a plurality of piece-of-music-dependent templates containing various information dependent on the pieces of music, including structures and chord progressions of the pieces of music, to generate melodies of the pieces of music, selecting a piece-of-music-independent template from the supplied plurality of piece-of-music-independent templates, selecting a piece-of-music-dependent template from the supplied plurality of piece-of-music-dependent templates, generating a rhythm of a piece of music, based on the rhythm characteristic of a piece of music contained in the selected piece-of-music-independent template and the structure of a piece of music contained in the selected piece-of-music-dependent template, generating skeleton pitches matching a piece of music to be generated by operation based on the common skeleton pitches contained in the selected piece-of-music-independent template and the structure and the chord progression of a piece of music contained in the selected piece-of-music-dependent template, allocating the generated skeleton pitches to important tone-generation point of the generated rhythm, and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

To attain the above object, according to a thirteenth aspect of the present invention, there is provided a machine readable storage medium storing a command for causing a machine to execute a method of automatically composing a piece of music according to each of the seventh to twelfth aspects of the present invention.

The above and other objects, features, and advantages of the present invention will become more apparent from the following detailed description taken in conjunction with the accompanying drawings.

BRIEF DESCRIPTION OF THE DRAWINGS

FIG. 4 is a block diagram showing a flow of melody pitch generating operation performed by an automatic composition apparatus according to a third embodiment of the present invention;

DETAILED DESCRIPTION OF THE PREFERRED EMBODIMENT

The present invention will now be described in detail with reference to the drawings showing embodiments thereof.

Figure 1:
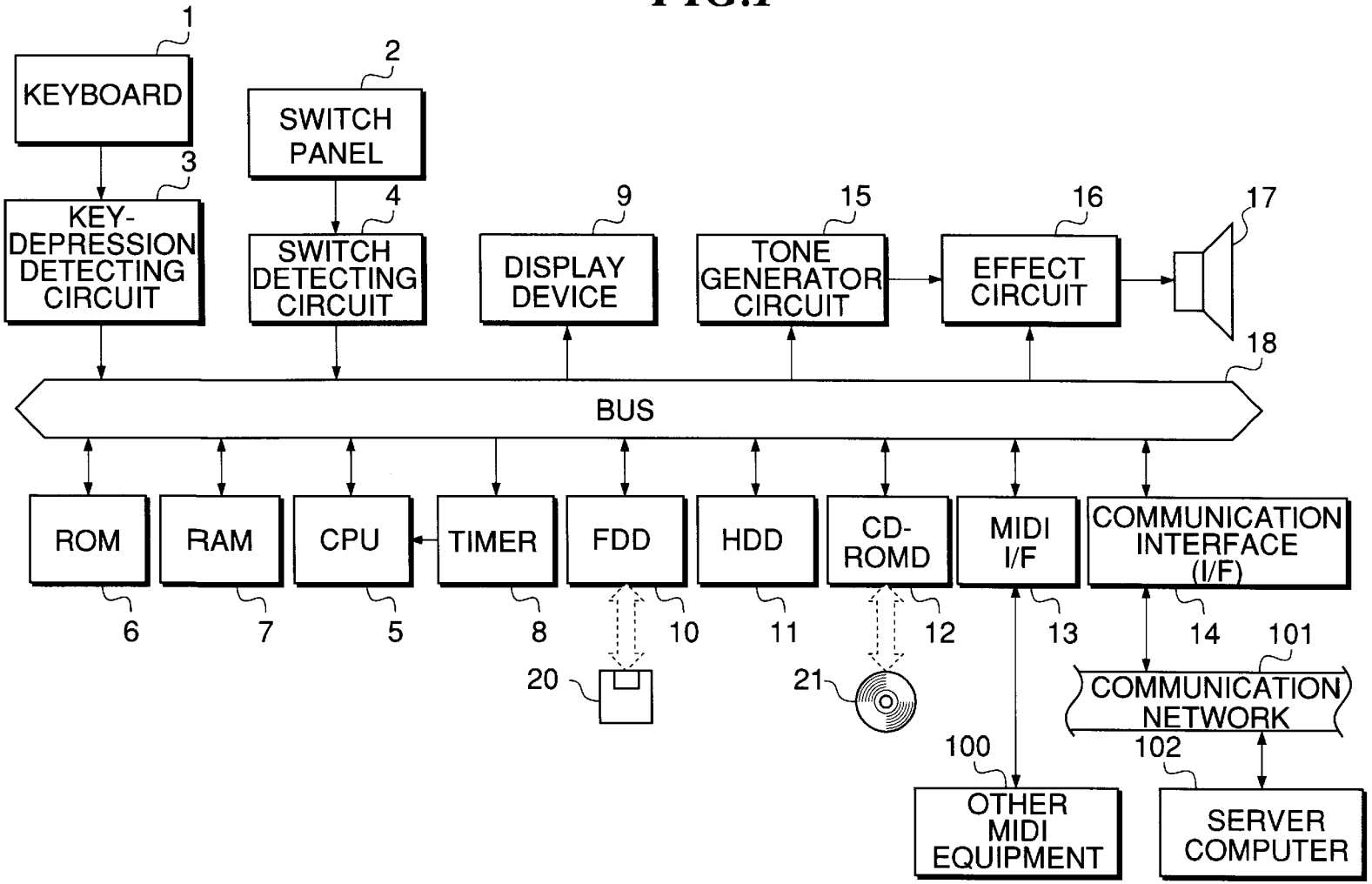
FIG. 1 is a block diagram schematically showing the construction of an automatic composition apparatus according to a first embodiment of the present invention.

FIG. 1 is a block diagram schematically showing the construction of an automatic composition apparatus according to a first embodiment of the present invention.

As shown in FIG. 1, the automatic composition apparatus of the present embodiment includes a keyboard 1 for entering pitch information, a switch panel 2 having a plurality of switches for entering various kinds of information, a key-depression detecting circuit 3 for detecting an operated or depressed state of each key on the keyboard 1, and a switch detecting circuit 4 for detecting an operated or depressed state of each switch on the switch panel 2. The automatic composition apparatus further includes a CPU 5 that governs control of the whole apparatus, a ROM 6 for storing a control program to be executed by the CPU 5, table data, and so forth, a RAM 7 for temporarily storing performance data, various input information and operation results, and a timer 8 for counting interrupt time and various kinds of times. The present apparatus further includes a display device 9 comprised of, for example, a large-sized liquid crystal display (LCD) or a CRT (Cathode Ray Tube) display and light emitting diodes (LED), for displaying various kinds of information, a floppy disc drive (FDD) 10 for driving a floppy disc (FD) 20 as one type of storage medium, a hard disk drive (HDD) 11 for driving a hard disk, not shown, that may store various application programs including the above-mentioned control program, and various kinds of data, and a CD-ROM drive (CD-ROMD) 12 for driving a CD-ROM (compact disc-read only memory) 21 that may store various application programs including the above-mentioned control program, and various kinds of data. The apparatus further includes a MIDI interface (I/F) 13 that receives MIDI (Musical Instrument Digital Interface) signals from external devices or equipment, and generates MIDI signals to external devices or equipment, a communication interface (I/F) 14 that transmits and receives data to and from a server computer 102, or the like, through a communication network 101, a tone generator circuit 15 that converts performance data entered through the keyboard 1, preset performance data, or the like, into musical tone signals, an effect circuit 16 that applies various sound effects to the musical tone signals received from the tone generator circuit 15, and a sound system 17 that converts the musical tone signals received from the effect circuit 16, into actual sound. The sound system 17 may be comprised of a DAC (Digital-to-Analog Converter), an amplifier, a loud speaker, or the like.

In the apparatus of the present embodiment, the above described components 3–16 are connected with each other via a bus 18. In addition, the timer 8 is connected to the CPU 5, and other MIDI equipment 100 is connected to the MIDI I/F 13, while a communication network 101 is connected to the communication I/F 14. Further, the effect circuit 16 is connected to the tone generator circuit 15, and the sound system 17 is connected to the effect circuit 16.

As described above, the hard disk mounted in the HDD 11 may store the control program to be executed by the CPU 5. Where a certain control program is not stored in the ROM 6, the hard disk may store the control program, which is read into RAM 7 so that the CPU 5 can perform the same operation as in the case where the control program is stored in the ROM 6. In this manner, a new control program can be easily added, or an existing program that has been already installed can be easily upgraded.

Programs including the control program or various data that have been read from the CD-ROM 21 set in the CD-ROM drive 12 are stored in the hard disk in the HDD 11. In this manner, a new control program can be easily installed and an existing program can be readily upgraded. The present apparatus may be provided with other external storage devices, such as a magneto-optic disc (MO) device, that can utilize various forms of storage media, in addition to or in place of the CD-ROM drive 12.

The MIDI I/F 13 is not limited to a dedicated interface, but may be composed of a general purpose interface, such as RS-232C, USB (Universal Serial Bus), and IEEE 1394. In this case, data other than MIDI message may also be received or transmitted.

As described above, the communication I/F 14 is connected to the communication network 101 which may be LAN (Local Area Network), Internet, or a telephone line, so as to be connected to the server computer 102 via the communication network 101. In the case where a certain program or a certain set of parameters is not stored in the hard disk within the HDD 11, the communication I/F 14 may be used for downloading the program or the parameters from the server computer 102. A client computer (i.e. the automatic composition apparatus in the present embodiment) sends a command to the server computer 102 via the communication network 101, to request downloading of the program or set of parameters. Upon receipt of the command, the server computer 102 delivers the requested program or set of parameters to the client computer, through the communication network 101. The client computer then receives the program or set of parameters through the communication I/F 14, and stores the same to the hard disk in HDD 11. In this manner, down loading is accomplished.

It is also possible to provide another interface for transmitting and receiving data directly to and from an external computer or the like.

Although the automatic composition apparatus of the present embodiment is implemented on a general purpose personal computer (PC) having a standard set of hardware components, this is not limitative. The apparatus may equally be implemented on, for example, a mobile PC that does not have FDD 10 or CD-ROMD 12. Further, instead of being implemented on a general purpose PC, the apparatus may be constructed as a dedicated apparatus.

The control operation performed by the automatic composition apparatus constructed as above will now be briefly summarized. Then, detailed description will be given with reference to FIG. 2.

The automatic composition apparatus of the present embodiment stores beforehand a plurality of piece-of-music-independent templates (hereinafter referred to as "piece-independent templates") and a plurality of piece-of-music-dependent templates (hereinafter referred to as "piece-dependent templates") in the ROM 6 or an external storage medium (the hard disk, FD 20, CD-ROM 21, or the like), and, when a user selects two templates, that is, one from each of the two groups of templates, generates melody data of a piece of music based on these templates.

Data stored in the piece-independent template include number of notes (for example, the number of notes included in one measure), presence of syncopation, magnitude of pitch dynamics, and so forth. Data stored in the piece-dependent template include chord progression, passage structure, and so forth.

The passage structure indicates whether each passage is identical or similar in structure to another passage. For example, if a certain passage is denoted by a symbol "A", another passage having a different passage structure (that is, a passage having no identical or similar structure) is denoted by a symbol "B". A passage having a passage structure identical to that of the certain passage is denoted by the symbol "A", and a passage having a passage structure similar to that of the certain passage is denoted by a symbol "A'" or "A"" ("A'" and "A"" are different in the degree of similarity such that the former is more similar to "A" than the latter).

While various data which are contained in one template in the prior art automatic composition apparatus that generates melody data of a piece of music based on a template, in the present embodiment, such data are classified into two kinds of templates (piece-independent template and piece-dependent template) and stored. A user selects two templates, one from each of the two kinds of templates, and melody data of a piece of music are generated based on data contained in the selected two templates. More specifically, the automatic composition apparatus of the present embodiment combines the data contained in the piece-independent template with the data contained in the piece-dependent template to form the data contained in one template in the prior art automatic composition apparatus, and generates melody data of a piece of music based upon the formed data. Therefore, for example, data contained in 25 templates in the prior art automatic composition apparatus can be reproduced using five piece-independent templates and five piece-dependent templates by the automatic composition apparatus of the present embodiment. Thus, it is possible with the automatic composition apparatus of the present embodiment to generate a large number of melodies with different atmospheres using a reduced number of melody generating templates (piece-independent templates and piece-dependent templates).

Figure 2:
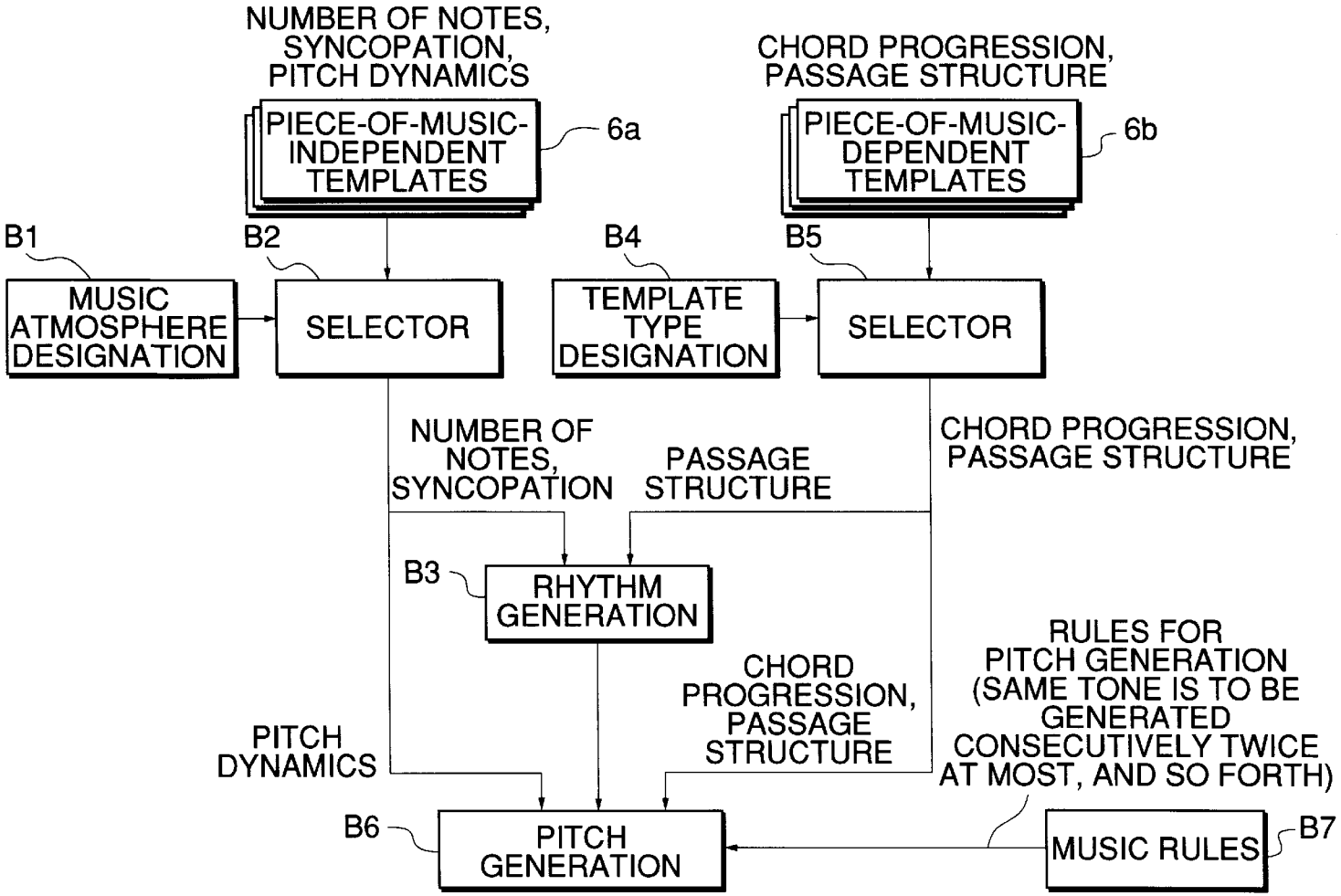
FIG. 2 is a block diagram showing a flow of melody pitch generating operation performed by the automatic composition apparatus of FIG. 1, in particular, by a CPU thereof.

FIG. 2 is a block diagram showing a flow of melody pitch generating operation performed by the automatic composition apparatus, in particular, by the CPU 5. The flow of melody pitch generating operation in FIG. 2 is shown, for the sake of explanation, not by a flowchart but by a block diagram. This is not a block diagram showing the operation of hardware, but a block diagram showing the operation of software. A plurality of piece-independent templates 6*a* and a plurality of piece-dependent templates 6*b* are also shown in this figure.

In FIG. 2, when a user designates a music atmosphere of a piece of music to be generated, the designated music atmosphere is stored, for example, in a work area of the RAM 7 (block B1), and a piece-independent template corresponding to the designated music atmosphere is selected by a selector (selecting operation) from a plurality of piece-independent templates 6*a* (block B2).

To each template of the plurality of piece-independent templates 6*a* is assigned a music atmosphere to be designated by users. Music atmospheres to be designated by users include, for example, "joyful", "lonely", and so forth. The music atmosphere "joyful" is assigned to a template containing data such as "the number of notes is large (for example, 6 to 10 notes in one measure)", "syncopation is present", and "pitch dynamics permits a jump up to 5 degrees". The music atmosphere "lonely" is assigned to a template containing data such as "the number of notes is small (for example, 1 to 5 notes in one measure)", "syncopation is absent", and "pitch dynamics permits a jump up to 3 degrees".

Thus, by simply designating a music atmosphere, a user can select a piece-independent template that matches the designated music atmosphere.

Among the data contained in the selected piece-independent template, the data as to "the number of notes" and "presence of syncopation" are entered into a rhythm generating operation block B3.

On the other hand when a user designates a desired type of template from the plurality of piece-dependent templates 6*b,* the designated type is stored, for example, in the above-mentioned work area (block B4), and a piece-dependent template corresponding to the designated type is selected from the plurality of piece-dependent templates 6*b* by a selector (selecting operation) (block B5).

Among data contained in the piece-dependent template selected in this manner, data as to passage structure are entered into the rhythm generating operation block B3.

In the rhythm generating operation block B3, a rhythm of a piece of music is generated based on data related to a rhythm characteristic included in the data contained in the piece-independent template, that is, the data as to "the number of notes" and "presence of syncopation" that have been entered into the block B3. On this occasion, data as to passage structure included in the data contained in the piece-dependent template are taken into account to generate a rhythm of a piece of music. Thus, a rhythm is generated such that, in a section having identical passage symbols (a section having, for example, passage symbols "A" and "A"), an identical rhythm is generated, and in a section having similar passage symbols (a section having, for example, passage symbols "A" and "A'"), similar rhythms are generated. Further, in a section having non-similar passage symbols (a section having, for example, passage symbols "A" and "B"), contrastive rhythms (rhythms in contrast as to the number of notes and presence of syncopation), or rhythms having no similarity or contrast are generated.

The rhythm of a piece of music generated in this manner is entered into a pitch generating operation block B6.

The data entered into the pitch generating operation block B6 include pitch dynamics that is included in the data contained in the piece-independent template selected by the above-mentioned selector block B2, chord progression and passage structure that are contained in the piece-dependent template selected by the above-mentioned selector block B5, and pitch generating rules from a music rule database B7 (specifically, the same tone is to be generated consecutively twice at most, and so forth).

In the pitch generating operation block B6, a pitch consistent with the various data entered is allocated to each tone-generation point of the rhythm generated by the rhythm generating operation block B3. Specifically, a pitch difference between the adjoining pitches is controlled by the entered pitch dynamics (for example, where the music atmosphere "joyful" is designated, the pitch dynamics is described as being large, so that a large pitch difference is chosen resulting in a jumping or lively pitch). Based on the entered passage structure, identical pitches are given in a section having identical passage symbols, similar pitches are given in a section having similar passage symbols, and pitches having no similarity are given in a section having non-similar passage symbols. Then, it is determined whether the pitches of a piece of music generated in this manner comply with the entered music rules or not. If the pitches do not comply with the music rules, other pitches are generated that comply with the music rules.

Next, an automatic composition apparatus according to a second embodiment of the present invention will be described.

The second embodiment is distinguished from the above described first embodiment in that skeleton pitches are automatically generated, these skeleton pitches are allocated to important tone-generation points of a generated rhythm, and subsequently the remaining pitches are generated. In the present embodiment, the term "skeleton" means a phrase skeleton, which is formed by the first pitch and the last pitch (hereinafter referred to as "node pitch") in each measure.

The present embodiment thus differs from the above described first embodiment only in a part of the melody pitch generating operation. Therefore, the present embodiment may be realized by the same hardware as in FIG. 1.

Figure 3:
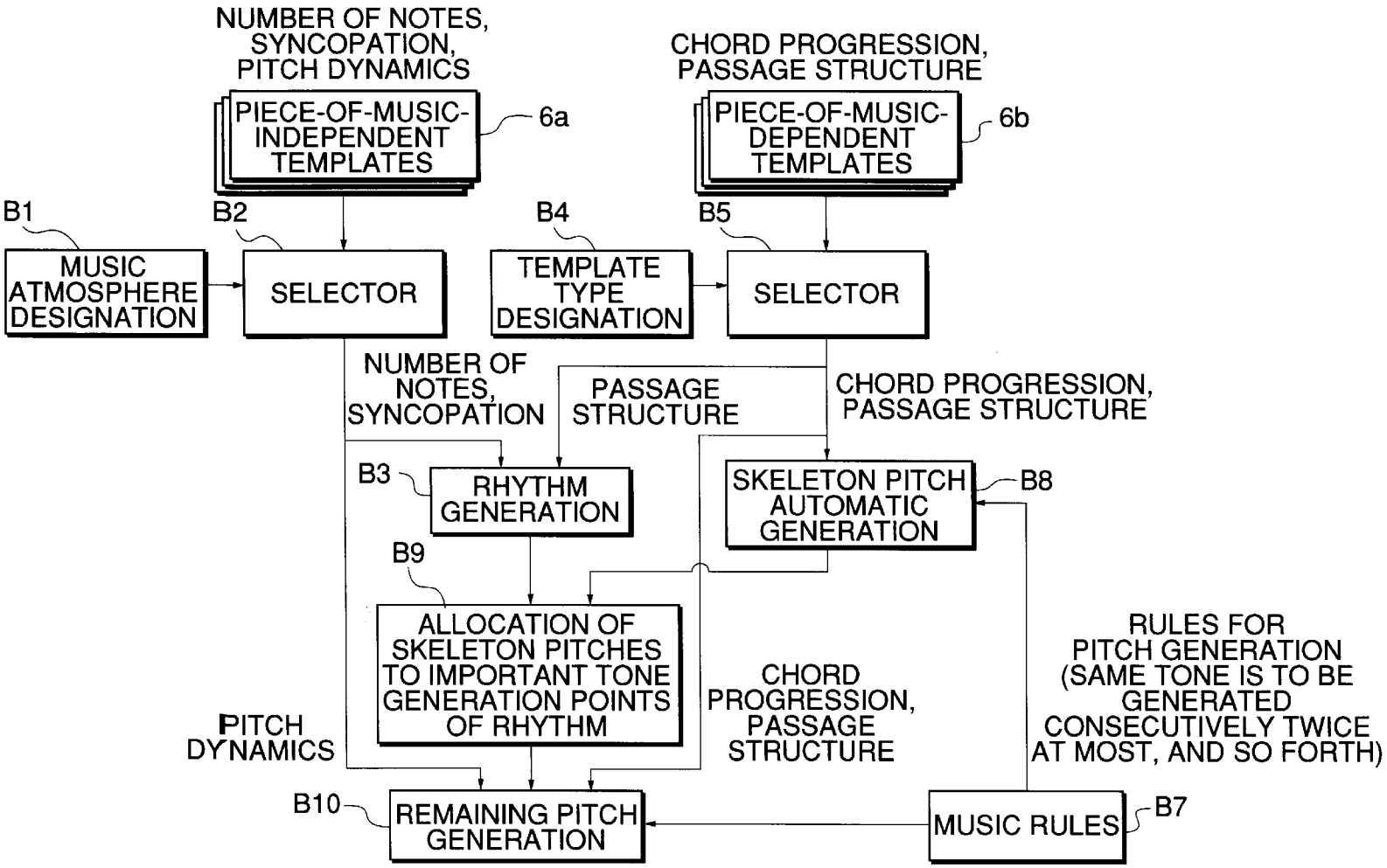
FIG. 3 is a block diagram showing a flow of melody pitch generating operation performed by an automatic composition apparatus according to a second embodiment of the present invention.

FIG. 3 is a block diagram showing a flow of the melody pitch generating operation performed by an automatic composition apparatus according to the present embodiment, in particular, by the CPU 5.

Since, as described above, the melody pitch generating operation according to the present embodiment differs only partially from the melody pitch generating operation of FIG. 2, the same operations (blocks) as of FIG. 2 are denoted by the same reference numerals, and the description of the operations is omitted.

In FIG. 3, data contained in a piece-dependent template selected by the selector block B5, that is, chord progression and passage structure, are entered into a skeleton pitch automatic generating operation block B8.

In the skeleton pitch automatic generating operation block B8, each node pitch of the phrase skeleton is automatically generated by selecting at random from the constituent notes of a chord forming the entered chord progression, two pitches, that is, the first pitch and the last pitch, in each measure. The pitches are generated based on the entered passage structure such that identical pitches are given in a section having identical passage symbols, similar pitches are given in a section having similar passage symbols, and pitches having no similarity are given in a section having non-similar passage symbols. Then, it is determined whether the node pitches of the phrase skeleton thus generated each comply with the entered music rules, and if they do not comply with the rules, other pitches complying with the rules are generated (block B7).

The skeleton pitches (node pitches) generated in the skeleton pitch automatic generating operation block B8 are entered into a block B9. In the block B9, the skeleton pitches are allocated to important tone-generation points of the rhythm generated by the block B3.

Here, the important tone-generation points of a rhythm are, for example, tone-generation points each corresponding to a downbeat (where there is no tone-generation point at a downbeat, a tone-generation point immediately before or after the down beat). When there is only one tone-generation point in a measure that can be an important tone-generation point, one of the above described two node pitches in the measure is allocated to the tone-generation point.

The skeleton pitches thus allocated to the important tone-generation points of the rhythm are entered into a remaining pitch generating operation block B10. Data entered into the remaining pitch generating operation block B10 include pitch dynamics among the data contained in the piece-independent template selected by the selector block B2, data contained in the piece-dependent template selected by the selector block B5, that is, chord progression and passage structure, and pitch generating rules from the music rule database B7 (specifically, the same tone is to generated consecutively twice at most, and so forth). Based on these data, the remaining pitch generating operation block B10 generates melody pitches of a piece of music by generating pitches other than the skeleton pitches.

Since according to the present embodiment, skeleton pitches of a piece of music are generated by operation based on passage structure and chord progression contained in the selected piece-dependent template, and the generated skeleton pitches are allocated to important tone-generation points of the generated rhythm, a melody having a sturdy skeleton and hence a high degree of perfection can be generated.

Next, a third embodiment of the present invention will be described.

The present embodiment is distinguished from the above described second embodiment in that proper skeleton pitches are stored in each template of a plurality of piece-dependent templates 6*b*′, and pitches are allocated to important tone-generation points of the rhythm based on these proper skeleton pitches (without automatically generating skeleton pitches).

The present embodiment thus differs from the second embodiment only in a part of the melody pitch generating operation. Therefore, the present embodiment may be realized by the same hardware as in FIG. 1.

FIG. 4 is a block diagram showing a flow of the melody pitch generating operation performed by an automatic composition apparatus according to the present embodiment, in particular, by the CPU 5.

Since, as described above, the melody pitch generating operation according to the present embodiment differs only partially from the melody pitch generating operation of FIG. 3, the same operations (blocks) as in FIG. 3 are denoted by the same reference numerals, and the description of the operations is omitted.

In FIG. 4, among the data contained in the piece-dependent template selected by the selector block B5, the proper skeleton pitches are entered into the block B9. In the block B9, the skeleton pitches are allocated to important tone-generation points of the rhythm generated by the block B3.

According to the present embodiment, skeleton pitches of a piece of music are contained in each piece-dependent template, and the skeleton pitches contained in the selected piece-dependent template are allocated to important tone-generation points of the generated rhythm. Therefore, a melody having a sturdier skeleton and a higher degree of perfection can be generated than by generating the skeleton pitches by operation.

Next, a fourth embodiment of the present invention will be described.

The present embodiment is realized by a combination of parts of the operations of the above described second and third embodiments. More specifically, skeletons are composed of a plurality of layers (for example, overall skeleton, passage skeleton, phrase skeleton), only pitches of a skeleton or skeletons of the higher layer(s) (for example, overall skeleton) are contained in each template of a plurality of piece-dependent templates 6*b*′, and the skeleton(s) of lower layer(s) (for example, passage skeleton and phrase skeleton) is(are) automatically generated based on the skeleton pitches of the higher layer(s).

The present embodiment is thus constructed of a combination of parts of the operations of the second and third embodiments. Therefore, the present embodiment may be realized by the same hardware as in FIG. 1.

Figure 5:
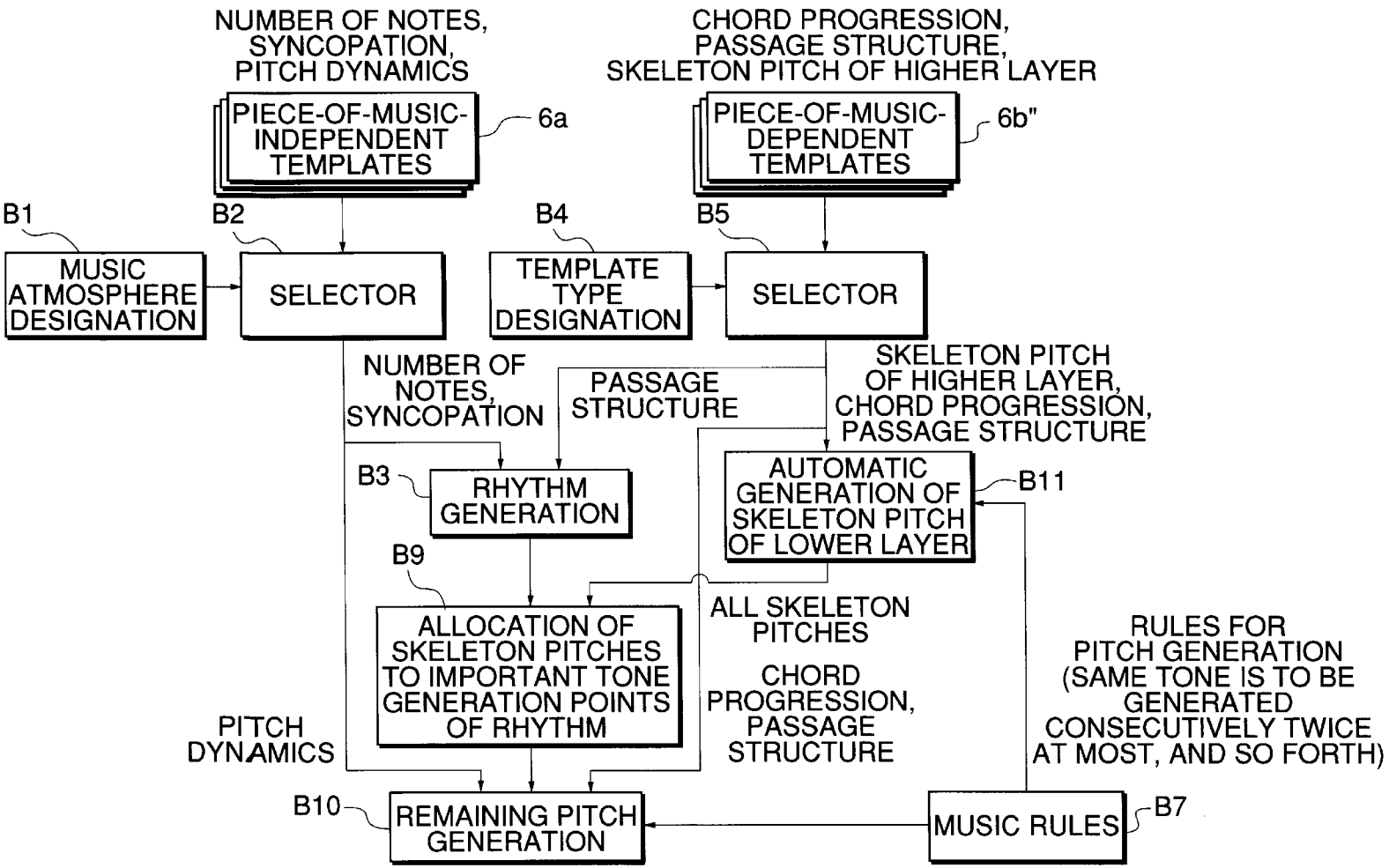
FIG. 5 is a block diagram showing a flow of melody pitch generating operation performed by an automatic composition apparatus according to a fourth embodiment of the present invention.

FIG. 5 is a block diagram showing a flow of the melody pitch generating operation performed by an automatic composition apparatus according to the present embodiment, in particular, by the CPU 5.

Since, as described above, the melody pitch generating operation according to the present embodiment is constructed of a combination of parts of the melody pitch generating operations of FIGS. 3 and 4, the same operations (blocks) as in FIGS. 3 and 4 are denoted by the same reference numerals, description of which is omitted.

In FIG. 5, data contained in the piece-dependent template selected by the selector block B5, that is, skeleton pitches of the highest layer, chord progression and passage structure are entered into a lower layer skeleton pitch automatic generating operation block B11. The lower layer skeleton pitch automatic generating operation block B11 generates all the skeleton pitches based on these data and the music rules, and supplies them to the block B9.

As described above, according to the present embodiment, skeleton pitches of the highest layer contained in the selected piece-dependent template and skeleton pitches of lower layers generated by operation based on structure, chord progression and the skeleton pitches of the highest layer of a piece of music are allocated to important tone-generation points of the generated rhythm. Therefore, a melody having a sturdier skeleton and a higher degree of perfection can be generated than by generating the skeleton pitches of all the layers by operation. Further, compared to describing skeleton pitches of all the layers in each piece-dependent template, the types of skeleton pitches can be increased, and the labor and time for generating the skeleton pitches of all the layers, as well as the capacity of the memory means required to store the skeleton pitches of all the layers, can be reduced.

Next, a fifth embodiment of the present invention will be described.

The present embodiment is distinguished from the above described third embodiment where proper skeleton pitches are stored in each template of a plurality of piece-dependent templates 6*b*′, and pitches are allocated to important tone-generation points of the rhythm based on the proper skeleton pitches, in that piece-independent common skeleton pitches are stored in each template of a plurality of piece-independent templates 6*a*′, and pitches are allocated to important tone-generation points of the rhythm based on the common skeleton pitches.

The present embodiment thus differs from the third embodiment only in a part of the melody pitch generating operation. Therefore, the present embodiment may be realized by the same hardware as in FIG. 1.

Figure 6:
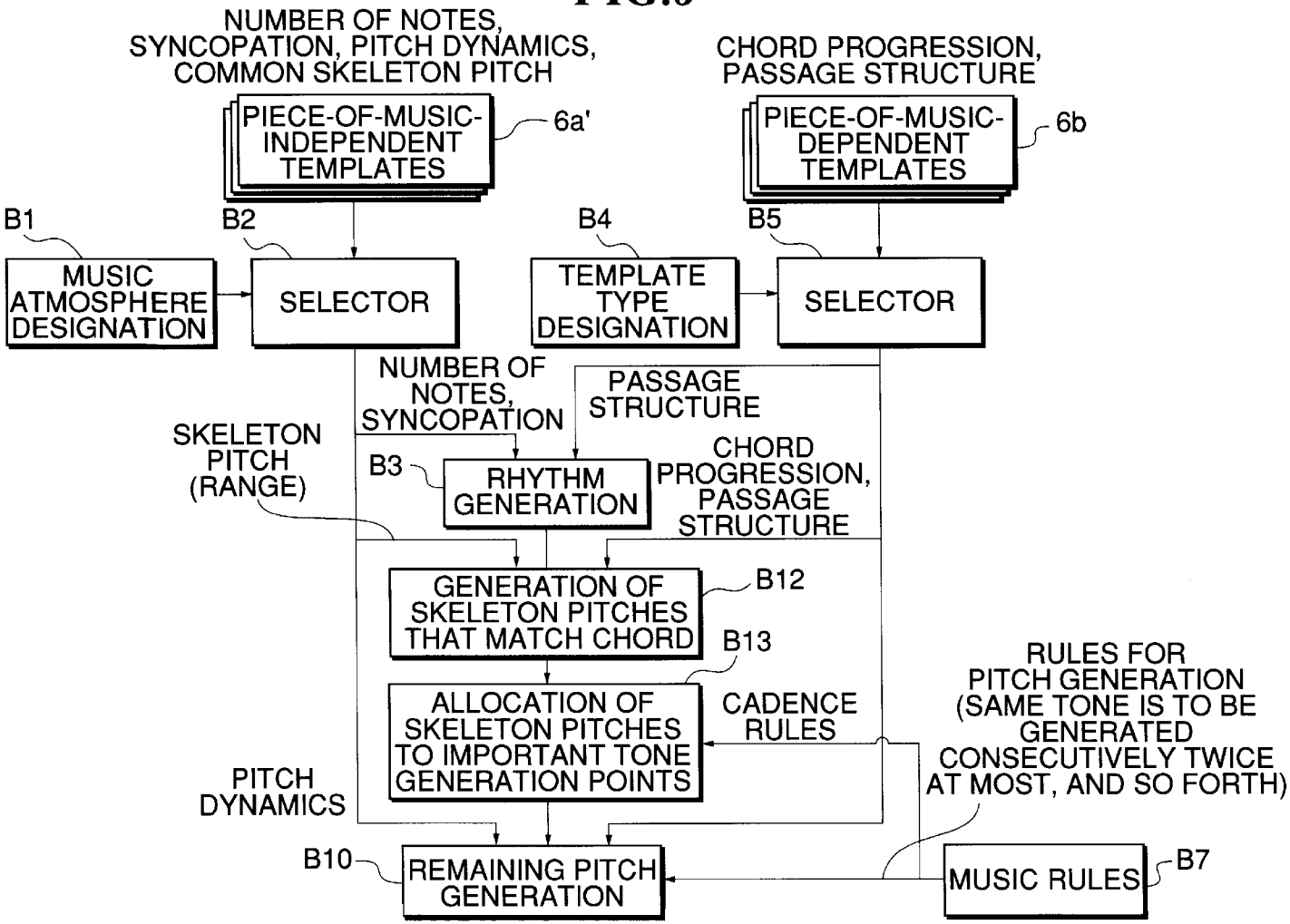
FIG. 6 is a block diagram showing a flow of melody pitch generating operation performed by an automatic composition apparatus according to a fifth embodiment of the present invention.

FIG. 6 is a block diagram showing a flow of the melody pitch generating operation performed by an automatic composition apparatus according to the present embodiment, in particular, by the CPU 5.

Since, as described above, the melody pitch generating operation according to the present embodiment differs only partially from the melody pitch generating operation of FIG. 4, the same operations (blocks) as in FIG. 4 are denoted by the same reference numerals, and the description of the operations is omitted.

Before the melody pitch generating operation of the present embodiment is described with reference to FIG. 6, the data format of the piece-independent common skeleton pitch will be described.

In the present embodiment, a skeleton pitch curve reflecting the evolution (introduction, development, turn and conclusion) or musical fluctuations (ups and downs or rise and fall) of a piece of music as a whole is stored in each piece-independent template as piece-independent common skeleton pitches. Only a skeleton pitch curve that matches a predetermined reference key (for example, CM or Am) are stored in the template. This makes it possible to adopt the skeleton pitch curve as piece-independent common skeleton pitches.

Figure 7:
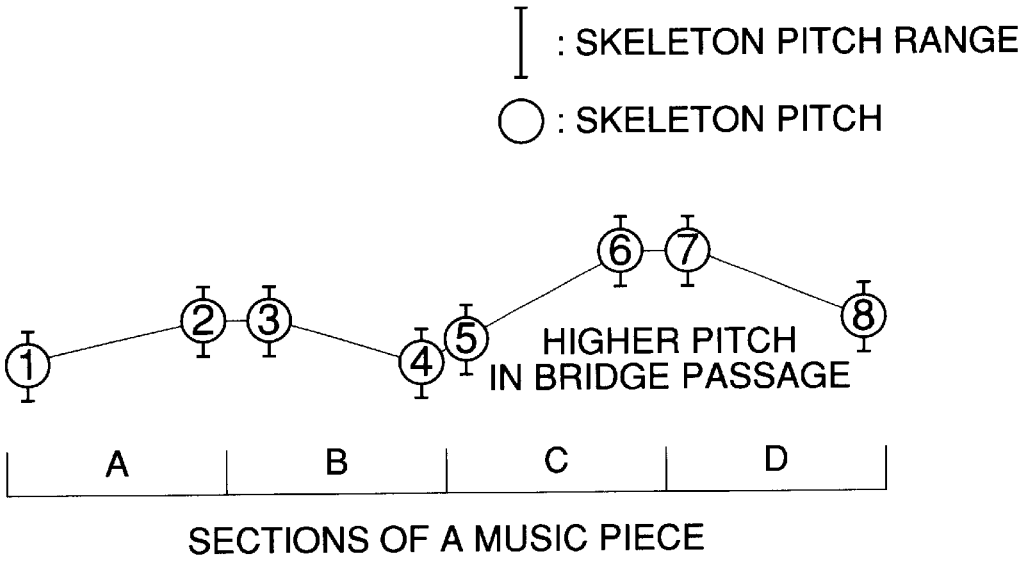
FIG. 7 is a view showing one example of data format of a piece-of-music-independent common skeleton pitch contained in a piece-of-music-independent template of FIG. 6.

An example of skeleton pitches is shown in FIG. 7, in which the pitch is set higher in a bridge section (between section C and section D) than in other sections.

The skeleton pitch curve in FIG. 7 shows an example in which the node pitch is "D" at the first and fourth nodes, "F" at the second and third nodes, "E" at the fifth node, "A" at the sixth and seventh nodes, and "G" at the eighth node.

Instead of skeleton pitches, skeleton pitch ranges may be stored in each template. An example of pitch ranges is also shown in FIG. 7. In this example, the pitch range of the node pitch shown is C–E at the first and fourth nodes, E–G at the second and third nodes, D–F at the fifth node, G–B at the sixth and seventh nodes, and F–A at the eighth node.

Alternatively to the skeleton pitch ranges, slope information showing a manner of variation of the pitch from the beginning to the end of a section may be stored in each template.

The melody pitch generating operation according to the present embodiment will now be described.

In FIG. 6, among the data contained in the piece-independent template selected by the selector block B2, skeleton pitches (or skeleton pitch ranges) are entered into a block B12. The block B12 generates skeleton pitches corresponding to the (piece-dependent) chord (progression) based on the chord progression and structure of a piece of music, and the generated rhythm, which are separately entered. Specifically, the skeleton pitches are generated as follows:

(1) Where a skeleton pitch is entered: The entered skeleton pitch is modified to a chord constituent note nearest to the pitch;

(2) Where a skeleton pitch range is entered: A chord constituent note falling in the entered pitch range is selected and applied.

When there are a plurality of eligible candidates, a pitch complying with a cadence rule stored in the music rule database B7 (a section ends in a perfect cadence or an imperfect cadence, and so forth) is selected and applied.

Where slope information is contained in the template, a pitch that matches the slope and complies with a music rule as to the cadence or the like may be selected in preference.

Further, where key information is contained in the piece-dependent template, the skeleton pitch (or the skeleton pitch range) may be shifted by the difference between the tonic of the reference key and the tonic of the key information.

If a large jump appears, the pitch may be modified to another pitch to make the jump smaller so as to obtain a smooth pitch curve.

The skeleton pitches thus generated by the block B12 are entered into a block B13. The block B13 allocates the entered skeleton pitches to important tone-generation points of the rhythm generated by the block B3, referring to the cadence rule from the music rule database B7.

As described above, according to the present embodiment, skeleton pitches that match a piece of music are generated by operation based on the common skeleton pitches contained in the selected piece-independent template, and the generated skeleton pitches are allocated to important tone-generation points of the generated rhythm. Therefore, skeleton pitches can be more easily generated than by storing them in piece-dependent templates. For example, for a plurality of piece-independent templates, skeleton pitches based on a certain reference key have only to be prepared, making it unnecessary to consider different keys for different pieces of music in preparing skeleton pitches.

It is to be understood that, in each of the above described embodiments, the kinds of data contained in each of the piece-independent templates and the piece-dependent templates are only exemplary, and data other than those described and illustrated may be included, or conversely, some data illustrated may be excluded.

It is also to be understood that while in the above described embodiments, the piece-independent template and the piece-dependent template are designated separately and independently, the invention is not limited to this form of designation. Alternatively, pairs of piece-independent template and piece-dependent template (the number of all the pairs may be equal to or less than the number of piece-independent templates multiplied by the number of piece-dependent templates) may be stored with names or numbers assigned thereto, so that a user has only to designate a name or a number to select the pair of a piece-independent template and a piece-dependent template having the name or the number.

Further, it is also to be understood that the algorithms used for generating a rhythm and pitches are not limited to those as described above, and any algorithms may be adopted without departing from the scope and spirit of the present invention. For example, for the generation of a rhythm, a multiplicity of rhythm patterns may be stored in a database in correspondence to the number of notes, and to the presence or absence of syncopation. A user may select any applicable one of the rhythm patterns based on the number of notes and the presence or absence of syncopation contained in the piece-independent template, or alternatively, after generating a rhythm pattern by operation, it may be determined whether the generated rhythm pattern complies with the number of notes and the presence or absence of syncopation contained in the piece-independent template, to thereby adopt an applicable rhythm pattern.

It is to be understood that the object of the present invention may also be accomplished by supplying a system or an apparatus with a storage medium in which a software program code that realizes the functions of any of the illustrated embodiments is recorded, and causing a computer (CPU 5 or MPU) of the system or apparatus to read out and execute the program code stored in the storage medium.

In this case, the program code itself read from the storage medium accomplishes the novel functions of the present invention, and thus the storage medium storing the program code constitutes the present invention.

The storage medium for supplying the above-mentioned program code to the system or apparatus may be selected from the floppy disc 20, a hard disk, an optical disk, a magneto-optic disk, the CD-ROM 21, a C-DR, a magnetic tape, a nonvolatile memory card, and the ROM 6. The program code may also be supplied from the other MIDI equipment 100, or the server computer 102 via the communication network 101.

The functions of the illustrated embodiments may be accomplished not only by executing the program code read by a computer, but also by causing an operating system (OS) on the computer, to perform a part or the whole of the actual operations according to instructions of the program code.

Furthermore, the program code read from the storage medium may be written into a memory provided in an expanded board inserted in the computer, or an expanded unit connected to the computer, and a CPU, or the like provided in the expanded board or expanded unit may actually perform a part or all of the operations according to the instructions of the program code, so as to accomplish the functions of the illustrated embodiments.

What is claimed is:

1. An automatic composition apparatus comprising:

a piece-of-music-independent template supplying device that supplies a plurality of piece-of-music-independent templates containing various information independent of pieces of music, to generate melodies of the pieces of music;

a piece-of-music-dependent template supplying device that supplies a plurality of piece-of-music-dependent templates containing various information dependent on the pieces of music, to generate melodies of the pieces of music;

a piece-of-music-independent template selecting device that selects a piece-of-music-independent template from the supplied plurality of piece-of-music-independent templates;

a piece-of-music-dependent template selecting device that selects a piece-of-music-dependent template from the supplied plurality of piece-of-music-dependent templates; and a melody generating device that generates a melody of a piece of music based on information contained in the selected piece-of-music-independent template and piece-of-music-dependent template.

2. An automatic composition apparatus as claimed in claim 1, further comprising a music rule supplying device that supplies music rules, and wherein said melody generating device generates the melody of the piece of music based on the supplied music rules.

3. An automatic composition apparatus as claimed in claim 1, further comprising a music atmosphere designating device that designates a music atmosphere from a plurality of music atmospheres, and wherein said piece-of-music-independent template supplying device supplies the plurality of piece-of-music-independent templates in correspondence to respective ones of the plurality of music atmospheres, and said piece-of-music-independent template selecting device selects a piece-of-music-independent template corresponding to the designated music atmosphere.

4. An automatic composition apparatus comprising:

a piece-of-music-independent template supplying device that supplies a plurality of piece-of-music-independent templates containing various information independent of pieces of music, including rhythm characteristics and pitch characteristics of the pieces of music, to generate melodies of the pieces of music;

a piece-of-music-dependent template supplying device that supplies a plurality of piece-of-music-dependent templates containing various information dependent on the pieces of music, including structures and chord progressions of the pieces of music, to generate melodies of the pieces of music;

a piece-of-music-independent template selecting device that selects a piece-of-music-independent template from the supplied plurality of piece-of-music-independent templates;

a piece-of-music-dependent template selecting device that selects a piece-of-music-dependent template from the supplied plurality of piece-of-music-dependent templates;

a rhythm generating device that generates a rhythm of a piece of music based on the rhythm characteristic of a piece of music contained in the selected piece-of-music-independent template and the structure of a piece of music contained in the selected piece-of-music-dependent template; and a melody generating device that generates a melody of a piece of music by generating a pitch for each tone-generation point of the generated rhythm, based on the pitch characteristic of a piece of music contained in the selected piece-of-music-independent template and the structure and chord progression of a piece of music contained in the selected piece-of-music-dependent template.

5. An automatic composition apparatus as claimed in claim 4, further comprising a music rule supplying device that supplies music rules, and wherein said melody generating device generates the melody of the piece of music based on the supplied music rules.

6. An automatic composition apparatus as claimed in claim 4, further comprising a music atmosphere designating device that designates a music atmosphere from a plurality of music atmospheres, and wherein said piece-of-music-independent template supplying device supplies the plurality of piece-of-music-independent templates in correspondence to respective ones of said plurality of music atmospheres, and said piece-of-music-independent template selecting device selects a piece-of-music-independent template corresponding to the designated music atmosphere.

7. An automatic composition apparatus as claimed in claim 4, wherein said rhythm characteristic includes a number of notes constituting the melody of the piece of music to be generated and presence or absence of syncopation in the piece of music to be generated, and wherein said pitch characteristic includes pitch dynamics of the notes constituting the melody of the piece of music to be generated.

8. An automatic composition apparatus comprising:

a piece-of-music-independent template supplying device that supplies a plurality of piece-of-music-independent templates containing various information independent of pieces of music, including rhythm characteristics and pitch characteristics of the pieces of music, to generate melodies of the pieces of music;

a piece-of-music-dependent template supplying device that supplies a plurality of piece-of-music-dependent templates containing various information dependent on the pieces of music, including structures and chord progressions of the pieces of music, to generate melodies of the pieces of music;

a piece-of-music-independent template selecting device that selects a piece-of-music-independent template from the supplied plurality of piece-of-music-independent templates;

a piece-of-music-dependent template selecting device that selects a piece-of-music-dependent template from the supplied plurality of piece-of-music-dependent templates;

a rhythm generating device that generates a rhythm of a piece of music based on the rhythm characteristic of a piece of music contained in the selected piece-of-music-independent template and the structure of a piece of music contained in the selected piece-of-music-dependent template;

a skeleton pitch generating device that generates skeleton pitches of a piece of music by operation based on the structure and chord progression of a piece of music contained in the selected piece-of-music-dependent template;

an allocating device that allocates the generated skeleton pitches to important tone-generation points of the generated rhythm; and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

9. An automatic composition apparatus as claimed in claim 8, further comprising a music rule supplying device that supplies music rules, and wherein said melody generating device generates the melody of the piece of music based on the supplied music rules.

10. An automatic composition apparatus as claimed in claim 8, further comprising a music atmosphere designating device that designates a music atmosphere from a plurality of music atmospheres, and wherein said piece-of-music-independent template supplying device supplies the plurality of piece-of-music-independent templates in correspondence to respective ones of said plurality of music atmospheres, and said piece-of-music-independent template selecting device selects a piece-of-music-independent template corresponding to the designated music atmosphere.

11. An automatic composition apparatus comprising:

a piece-of-music-independent template supplying device that supplies a plurality of piece-of-music-independent templates containing various information independent of pieces of music, including rhythm characteristics and pitch characteristics of the pieces of music, to generate melodies of the pieces of music;

a piece-of-music-dependent template supplying device that supplies a plurality of piece-of-music-dependent templates containing various information dependent on the pieces of music, including structures, chord progressions and skeleton pitches of the pieces of music, to generate melodies of the pieces of music;

a piece-of-music-independent template selecting device that selects a piece-of-music-independent template from the supplied plurality of piece-of-music-independent templates;

a piece-of-music-dependent template selecting device that selects a piece-of-music-dependent template from the supplied plurality of piece-of-music-dependent templates;

a rhythm generating device that generates a rhythm of a piece of music based on the rhythm characteristic of a piece of music contained in the selected piece-of-music-independent template and the structure of a piece of music contained in the selected piece-of-music-dependent template;

an allocating device that allocates the skeleton pitches contained in the selected piece-of-music-dependent template to important tone-generation points of the generated rhythm; and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

12. An automatic composition apparatus as claimed in claim 11, further comprising a music rule supplying device that supplies music rules, and wherein said melody generating device generates the melody of the piece of music based on the supplied music rules.

13. An automatic composition apparatus as claimed in claim 11, further comprising a music atmosphere designating device that designates a music atmosphere from a plurality of music atmospheres, and wherein said piece-of-music-independent template supplying device supplies the plurality of piece-of-music-independent templates in correspondence to respective ones of said plurality of music atmospheres, and said piece-of-music-independent template selecting device selects a piece-of-music-independent template corresponding to the designated music atmosphere.

14. An automatic composition apparatus comprising:

a piece-of-music-independent template supplying device that supplies a plurality of piece-of-music-independent templates containing various information independent of pieces of music, including rhythm characteristics and pitch characteristics of the pieces of music, to generate melodies of the pieces of music;

a piece-of-music-dependent template supplying device that supplies a plurality of piece-of-music-dependent templates containing various information dependent on the pieces of music, including structures and chord progressions of the pieces of music, and skeleton pitches of at least one higher layer among skeleton pitches of a plurality of layers that constitute a piece of music, to generate melodies of the pieces of music;

a piece-of-music-independent template selecting device that selects a piece-of-music-independent template from the supplied plurality of piece-of-music-independent templates;

a piece-of-music-dependent template selecting device that selects a piece-of-music-dependent template from the supplied plurality of piece-of-music-dependent templates;

a rhythm generating device that generates a rhythm of a piece of music based on the rhythm characteristic of a piece of music contained in the selected piece-of-music-independent template and the structure of a piece of music contained in the selected piece-of-music-dependent template;

a skeleton pitch generating device that generates skeleton pitches of at least one lower layer of a piece of music by operation based on the structure and chord progression of a piece of music, and the skeleton pitches of at least one higher layer of a piece of music contained in the selected piece-of-music-dependent template;

an allocating device that allocates the skeleton pitches of at least one higher layer of a piece of music contained in the selected piece-of-music-dependent template and the generated skeleton pitches of at least one lower layer of a piece of music, to important tone-generation points of the generated rhythm; and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

15. An automatic composition apparatus as claimed in claim 14, further comprising a music rule supplying device that supplies music rules, and wherein said melody generating device generates the melody of the piece of music based on the supplied music rules.

16. An automatic composition apparatus as claimed in claim 14, further comprising a music atmosphere designating device that designates a music atmosphere from a plurality of music atmospheres, and wherein said piece-of-music-independent template supplying device supplies the plurality of piece-of-music-independent templates in correspondence to respective ones of said plurality of music atmospheres, and said piece-of-music-independent template selecting device selects a piece-of-music-independent template corresponding to the designated music atmosphere.

17. An automatic composition apparatus as claimed in claim 14, wherein said skeleton pitches of a piece of music comprise a plurality of layers formed of overall skeleton pitches, passage skeleton pitches and phrase skeleton pitches of the piece of music, said overall skeleton pitches forming a highest layer, said passage skeleton pitches and said phrase skeleton pitches forming lower layers in an order mentioned.

18. An automatic composition apparatus comprising:

a piece-independent template supplying device that supplies a plurality of piece-of-music-independent templates containing various information independent of pieces of music, including rhythm characteristics and pitch characteristics of the pieces of music, and common skeleton pitches independent of the pieces of music, to generate melodies of the pieces of music;

a piece-of-music-dependent template supplying device that supplies a plurality of piece-of-music-dependent templates containing various information dependent on the pieces of music, including structures and chord progressions of the pieces of music, to generate melodies of the pieces of music;

a piece-of-music-independent template selecting device that selects a piece-of-music-independent template from the supplied plurality of piece-of-music-independent templates;

a piece-of-music-dependent template selecting device that selects a piece-of-music-dependent template from the supplied plurality of piece-of-music-dependent templates;

a rhythm generating device that generates a rhythm of a piece of music based on the rhythm characteristic of a piece of music contained in the selected piece-of-music-independent template and the structure of a piece of music contained in the selected piece-of-music-dependent template;

a skeleton pitch generating device that generates skeleton pitches matching a piece of music to be generated by operation based on the common skeleton pitches contained in the selected piece-of-music-independent template and the structure and the chord progression of a piece of music contained in the selected piece-of-music-dependent template;

an allocating device that allocates the generated skeleton pitches to important tone-generation points of the generated rhythm; and a melody generating device that generates a melody of a piece of music by generating a pitch for each tone-generation point other than the important tone-generation points of the generated rhythm to which the generated skeleton pitches were allocated, based on the pitch characteristic of a piece of music contained in the selected piece-of-music-independent template and the structure and chord progression of a piece of music contained in the selected piece-of-music-dependent template.

19. An automatic composition apparatus as claimed in claim 18, further comprising a music rule supplying device that supplies music rules, and wherein said melody generating device generates the melody of the piece of music based on the supplied music rules.

20. An automatic composition apparatus as claimed in claim 18, further comprising a music atmosphere designating device that designates a music atmosphere from a plurality of music atmospheres, and wherein said piece-of-music-independent template supplying device supplies the plurality of piece-of-music-independent templates in correspondence to respective ones of said plurality of music atmospheres, and said piece-of-music-independent template selecting device selects a piece-of-music-independent template corresponding to the designated music atmosphere.

21. A method of automatically composing a piece of music, comprising the steps of:

supplying a plurality of piece-of-music-independent templates containing various information independent of pieces of music, to generate a melody of a piece of music;

supplying a plurality of piece-of-music-dependent templates containing various information dependent on the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates; and generating a melody of a piece of music based on the information contained in the selected piece-of-music-independent template and piece-of-music-dependent template.

22. A method of automatically composing a piece of music, comprising the steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures and chord progressions of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template; and generating a melody of a piece of music by generating a pitch for each tone-generation point of the generated rhythm, based on the pitch characteristic of a piece of music contained in the selected piece-of-music-independent template and the structure and the chord progression of a piece of music contained in the selected piece-of-music-dependent template.

23. A method of automatically composing a piece of music, comprising steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures and chord progressions of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

generating skeleton pitches of a piece of music by operation based on the structure and the chord progression of a piece of music contained in the selected piece-of-music-dependent template;

allocating the generated skeleton pitches to important tone-generation points of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

24. A method of automatically composing a piece of music, comprising steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures, chord progressions and skeleton pitches of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

allocating skeleton pitches of a piece of music contained in the selected piece-of-music-dependent template, to important tone-generation points of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

25. A method of automatically composing a piece of music, comprising the steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures and chord progressions of the pieces of music, and skeleton pitches of at least one higher layer among skeleton pitches of a plurality of layers that constitute a piece of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

generating skeleton pitches of at least one lower layer of a piece of music by operation based on the structure and the chord progression of a piece of music and the skeleton pitches of at least one higher layer of a piece of music contained in the selected piece-of-music-dependent template;

allocating the skeleton pitches of at least one higher layer of a piece of music contained in the selected piece-of-music-dependent template and the generated skeleton pitches of at least one lower layer of a piece of music, to important tone-generation points of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

26. A method of automatically composing a piece of music, comprising the steps of:

supplying a plurality of piece-of-music-independent templates containing various information independent of pieces of music, including rhythm characteristics and pitch characteristics of the pieces of music and common skeleton pitches independent of the pieces of music, to generate melodies of the pieces of music;

supplying a plurality of piece-of-music-dependent templates containing various information dependent on the pieces of music, including structures and chord progressions of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

generating skeleton pitches matching a piece of music to be generated by operation based on the common skeleton pitches contained in the selected piece-of-music-independent template and the structure and the chord progression of a piece of music contained in the selected piece-of-music-dependent template;

allocating the generated skeleton pitches to important tone-generation point of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

27. A machine readable storage medium storing a command for causing a machine to execute a method of automatically composing a piece of music, the method comprising the steps of:

supplying a plurality of piece-of-music-independent templates containing various information independent of pieces of music, to generate a melody of a piece of music;

supplying a plurality of piece-of-music-dependent templates containing various information dependent on the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates; and generating a melody of a piece of music based on the information contained in the selected piece-of-music-independent template and piece-of-music-dependent template.

28. A machine readable storage medium storing a command for causing a machine to execute a method of automatically composing a piece of music, the method comprising the steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures and chord progressions of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template; and generating a melody of a piece of music by generating a pitch for each tone-generation point of the generated rhythm, based on the pitch characteristic of a piece of music contained in the selected piece-of-music-independent template and the structure and the chord progression of a piece of music contained in the selected piece-of-music-dependent template.

29. A machine readable storage medium storing a command for causing a machine to execute a method of automatically composing a piece of music, the method comprising the steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures and chord progressions of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

generating skeleton pitches of a piece of music by operation based on the structure and the chord progression of a piece of music contained in the selected piece-of-music-dependent template;

allocating the generated skeleton pitches to important tone-generation points of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

30. A machine readable storage medium storing a command for causing a machine to execute a method of automatically composing a piece of music, which comprises the steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures, chord progressions and skeleton pitches of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

allocating skeleton pitches of a piece of music contained in the selected piece-of-music-dependent template, to important tone-generation points of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

31. A machine readable storage medium storing a command for causing a machine to execute a method of automatically composing a piece of music, the method comprising the steps of:

supplying a plurality of piece-of-music-independent templates containing various information independent of pieces of music, including rhythm characteristics and pitch characteristics of the pieces of music, to generate melodies of the pieces of music;

supplying a plurality of piece-of-music-dependent templates containing various information dependent on the pieces of music, including structures and chord progressions of the pieces of music, and skeleton pitches of at least one higher layer among skeleton pitches of a plurality of layers that constitute a piece of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

generating skeleton pitches of at least one lower layer of a piece of music by operation based on the structure and the chord progression of a piece of music and the skeleton pitches of at least one higher layer of a piece of music contained in the selected piece-of-music-dependent template;

allocating the skeleton pitches of at least one higher layer of a piece of music contained in the selected piece-of-music-dependent template and the generated skeleton pitches of at least one lower layer of a piece of music, to important tone-generation points of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

32. A machine readable storage medium storing a command for causing a machine to execute a method of automatically composing a piece of music, the method comprising the steps of:

supplying a plurality of piece-of-music-independent templates containing various information independent of pieces of music, including rhythm characteristics and pitch characteristics of the pieces of music and common skeleton pitches independent of the pieces of music, to generate melodies of the pieces of music;

supplying a plurality of piece-of-music-dependent templates containing various information dependent on the pieces of music, including structures and chord progressions of the pieces of music, to generate melodies of the pieces of music;

selecting a piece-of-music-independent template from the supplied plurality of piece-of-music-independent templates;

selecting a piece-of-music-dependent template from the supplied plurality of piece-of-music-dependent templates;

generating a rhythm of a piece of music, based on the rhythm characteristic of a piece of music contained in the selected piece-of-music-independent template and the structure of a piece of music contained in the selected piece-of-music-dependent template;

generating skeleton pitches matching a piece of music to be generated by operation based on the common skeleton pitches contained in the selected piece-of-music-independent template and the structure and the chord progression of a piece of music contained in the selected piece-of-music-dependent template;

allocating the generated skeleton pitches to important tone-generation point of the generated rhythm; and generating a melody of a piece of music by generating a pitch for each tone-generation point other than the allocated important tone-generation points of the generated rhythm to which the generated skeleton pitches were allocated, based on the pitch characteristic of a piece of music contained in the selected piece-of-music-independent template and the structure and the chord progression of a piece of music contained in the selected piece-of-music-dependent template.

* * * * *